US005123798A

United States Patent [19]

Glösmann et al.

[11] Patent Number: 5,123,798

[45] Date of Patent: Jun. 23, 1992

[54] APPARATUS FOR MANIPULATING TRAYS FOR CIGARETTES AND THE LIKE

[75] Inventors: Josef Glösmann, Hamburg; Karl-Heinz Grieben, Schwarzenbeck; Andreas Rinke, Bad Oldesloe, all of Fed. Rep. of Germany

[73] Assignee: Körber AG, Hamburg, Fed. Rep. of Germany

[21] Appl. No.: 525,078

[22] Filed: May 17, 1990

[30] Foreign Application Priority Data

May 26, 1989 [DE] Fed. Rep. of Germany ..... 3917097

[51] Int. Cl.[5] ..... A24C 5/352

[52] U.S. Cl. ..... 414/403; 414/621

[58] Field of Search ..... 414/283, 403, 332, 331, 414/266, 268, 281, 409, 450, 451, 620, 628, 621, 633, 642; 198/347.2, 435; 131/282, 283

[56] References Cited

U.S. PATENT DOCUMENTS

| | | | |
|---|---|---|---|
| 2,699,879 | 1/1955 | Bertram | 414/621 |
| 3,245,558 | 4/1966 | Kochalski . | |
| 3,302,804 | 2/1967 | Harris | 414/283 |
| 3,527,369 | 6/1968 | Bornfleth . | |
| 3,655,080 | 4/1972 | Gianese | 414/403 |
| 3,672,522 | 6/1972 | Wahle . | |
| 3,750,676 | 8/1973 | Kruse | 131/25 |
| 3,921,790 | 11/1975 | Hinchcliffe | 414/403 |
| 4,278,385 | 7/1981 | Bardenhagen | 414/419 |
| 4,353,675 | 10/1982 | Risener et al. | 414/403 |
| 4,548,019 | 10/1985 | Kruse | 53/170 |
| 4,564,329 | 1/1986 | Bantien | 414/403 |
| 4,697,603 | 10/1987 | Steinhauer | 131/84.4 |
| 4,776,351 | 10/1988 | Wahle | 131/69 |
| 4,892,453 | 1/1990 | Bantien | 414/403 |

*Primary Examiner*—Jesûs D. Sotelo

*Attorney, Agent, or Firm*—Peter K. Kontler

[57] ABSTRACT

A unit which serves to fill trays with surplus cigarettes adjacent the path of movement of a mass flow of cigarettes from a maker to a processing machine is disposed at a level beneath a unit which empties the contents of filled trays into the mass flow when the requirements of the processing machine exceed the output of the maker. Each unit stores empty trays at an upper level and filled trays at a lower level. The two units are adjacent a device which serves to transfer trays between the storeys as well as between the two units on the one hand and a reservoir for additional empty and filled trays on the other hand. The tray transferring device has two superimpoosed tray holders which are indexible by a turret about a vertical axis, which can be turned about a second axis relative to the turret, which can be moved up and down along the turret, and which can be tilted relative to horizontal axes to change the inclination of trays and to thus prevent stacked cigarettes from falling out of filled trays during transport of such trays with the respective holders.

13 Claims, 5 Drawing Sheets

APPARATUS FOR MANIPULATING TRAYS FOR CIGARETTES AND THE LIKE

BACKGROUND OF THE INVENTION

The invention relates to apparatus for manipulating trays (also known as chargers) for temporary storage of filter rod sections and/or plain or filter cigarettes, cigars, cigarillos and analogous rod-shaped articles of the tobacco processing industry. More particularly, the invention relates to improvements in apparatus for manipulating trays which serve (a) to receive rod-shaped articles from a mass flow of articles between one or more producing and one or more consuming or processing machines, and (b) to admit rod-shaped articles into the mass flow.

Direct coupling of producing (such as cigarette making or filter tipping) machines with processing or consuming (such as packing) machines is becoming an increasing popular mode of transferring large quantities of rod-shaped articles of the tobacco processing industry (see, for example, commonly owned U.S. Pat. No. 4,892,453 granted Jan. 9, 1990 to Bantien et al.). However, and since the output of a single producing machine or the combined output of two or more producing machines does not always match the requirements of the processing or consuming machine or machines, it is necessary to employ so-called buffer stations with equipment which can temporarily store the surplus of the output of the producing machine or machines when the output exceeds the requirements of the associated processing machine or machines, and which can supplement the output of the producing machine or machines when the requirements of the processing machine or machines cannot be met by the maker or makers.

A presently preferred buffer station employs a so-called tray filling or charger filling unit serving to draw rod-shaped articles from the path along which a mass flow of articles advances from the producing machine or machines to the processing machine or machines when the output of the producing machine or machines exceeds the requirements of the processing machine or machines, and a so-called tray evacuating or charger evacuating unit which can discharge the contents of filled trays into the path in order to ensure that the requirements of the processing machine or machines can be met when the output of the producing machine or machines is too low. The buffer station further accommodates a conveyor system or transfer system which serves to transport empty trays from the evacuating unit to the filling unit and to transport filled trays from the filling unit to the evacuating unit. Certain presently known tray evacuating units employ a so-called inverting head (see, for example, U.S. Pat. No. 3,527,369 granted Sep. 8, 1970 to Bornfleth et al..and commonly owned U.S. Pat. No. 4,278,385 granted Jul. 14, 1981 to Bardenhagen et al.) which serves to turn a filled tray through approximately 180° about an axis which is parallel with a longitudinally extending edge of the tray; this entails a change of orientation of rod-shaped articles through 180°. In order to ensure that the orientation of articles which are returned into the mass flow will match the orientation of articles which form the mass flow, it is customary to reorient empty trays on their way from the evacuating unit to the filling unit.

Satisfactory orientation of rod-shaped articles of the tobacco processing industry is important when the articles are filter cigarettes, cigars or cigarillos, i.e., when the articles do not consist of pairs of mirror symmetrical halves. The same holds true if the articles are plain cigarettes which are provided with printed matter, such as the name of the manufacturer, the brand name or the like; the orientation of printed matter on each article in the mass flow must be the same. Therefore, the equipment at the aforementioned buffer station must be capable of ensuring that the orientation of rod-shaped articles (hereinafter referred to mainly as cigarettes or filter cigarettes but with the understanding that the apparatus can be used with equal advantage for the treatment of other types of rod-shaped articles of the tobacco processing industry) which are returned into the mass flow will be the same as the orientation of all other articles in the mass flow.

The tray filling and evacuating units are normally designed to store empty trays at a first level and to store filled trays at a different second level. Reference may be had, for example, to commonly owned U.S. Pat. No. 4,564,329 granted Jan. 14, 1986 to Bantien. Furthermore, the units are equipped with means for transferring trays between the two levels.

A drawback of presently known buffer stations is that the equipment at such stations occupies much space and that the mechanisms which serve to change the orientation of trays are complex and expensive.

OBJECTS OF THE INVENTION

An object of the invention is to provide an apparatus which can manipulate and temporarily store large numbers of empty and filled chargers or trays in a small area.

Another object of the invention is to provide an apparatus the capacity of which greatly exceeds the capacities of heretofore known apparatus for the manipulation of empty and filled trays for rod-shaped articles of the tobacco processing industry.

A further object of the invention is to provide an apparatus which can be installed in existing production lines for cigarettes or other rod-shaped articles of the tobacco processing industry.

An additional object of the invention is to provide an apparatus which can treat the articles gently and which can invariably maintain requisite numbers of empty and filled trays in optimum positions of readiness for receiving rod-shaped articles when the output of the making machine or machines exceeds the requirements of the processing machine or machines, and for supplying rod-shaped articles when the requirements of the processing machine or machines exceed the output of the making machine or machines.

Still another object of the invention is to provide the apparatus with novel and improved means for transferring empty and filled trays.

A further object of the invention is to provide the apparatus with a novel and improved combination of tray filling and evacuating units.

Another object of the invention is to provide an apparatus wherein the trays must cover short distances within as well as between the tray filling and tray evacuating units.

An additional object of the invention is to provide the apparatus with novel and improved means for temporary storage of filled and/or empty trays outside of the tray filling and tray evacuating units.

A further object of the invention is to provide an apparatus which is more versatile and more compact than heretofore known apparatus for the manipulation of containers of the type known as chargers or trays which are designed to store large numbers of rod-shaped articles of the tobacco processing industry.

SUMMARY OF THE INVENTION

The invention is embodied in an apparatus for manipulating empty and filled trays or analogous containers (hereinafter called trays for short) for temporary storage of rod-shaped articles of the tobacco processing industry which are conveyed along a predetermined path extending between at least one first machine (e.g., a cigarette rod making machine or a filter tipping machine) and at least one second machine (such as a packing or another cigarette processing machine). The improved apparatus comprises a tray filling unit having means for converting empty trays into filled trays by removing articles from the predetermined path when the output of the at least one first machine exceeds the requirements of the at least one second machine, and a tray evacuating unit having means for converting filled trays into empty trays by delivering articles from filled trays into the predetermined path when the requirements of the at least one second machine exceed the output of the at least one first machine. Each of the two units has first and second facilities (e.g., discrete storeys) for temporary storage of batteries of preferably parallel empty and filled trays, respectively, and the first and second facilities of each of the two units are preferably disposed at different levels. In accordance with an advantageous feature of the invention, the two units are designed and constructed to form a compact assembly wherein the facilities of one of the units are preferably immediately or closely adjacent the facilities of the other unit. The apparatus further comprises novel and improved means for transferring trays between the facilities of the two units. The assembly of the two units can resemble or constitute a block- or turret-shaped structure.

The arrangement is preferably such that one of the units (e.g., the tray evacuating unit) is disposed above the other unit. The first facilities of each unit are preferably disposed at a level above the respective second facilities, i.e., the first facility of the evacuating unit can be located above the second facility of this unit, the first facility of the filling unit can be located beneath the second facility of the evacuating unit, and the second facility of the filling unit can be located beneath the first facility of this unit.

The transferring means preferably comprises an upper and a lower tray holder, and each such holder has means for releasably engaging and moving at least one tray (preferably a single tray) so that an empty tray which is carried by one of the holders can be transferred simultaneously with a filled tray which is carried by the other holder. Such transferring means can further comprise a turret or an analogous support for the holders, and means for indexing the turret about a substantially vertical axis. Still further, the transferring means can comprise an elevator with means for moving the holders up and down relative to the turret, and means for rotating the holders relative to the turret clockwise and counterclockwise about a second substantially vertical axis, preferably through angles of substantially 180°. The second vertical axis is preferably normal to the axes of articles in a filled tray which is carried by one of the holders.

The transferring means can also comprise means for tilting the holders relative to the turret about substantially horizontal axes. The horizontal axes are preferably adjacent the upper portions of the holders, and each holder is preferably tiltable to and from a predetermined position of inclination with reference to a vertical plane, namely to and from a position in which the articles in a filled tray which is carried by one of the holders are less likely to fall out of the tray during transport of such tray with the respective holder.

The engaging and moving means of each holder can comprise tongs having grippers and means for moving the grippers into and from engagement with trays in the respective holders. The trays are normally of a type having pairs of narrow sides and wide sides, and the grippers preferably include means for engaging the narrow sides of the trays in the respective holders. Each of the tongs can comprise two substantially parallel grippers, and such grippers can be provided with means, e.g., substantially horizontal arms at their lower ends) for engaging and supporting the trays from below.

The apparatus can further comprise a reservoir for filled and empty trays, and such reservoir has first and second facilities for temporary storage of empty and filled trays, respectively. The transferring means is disposed between the reservoir on the one hand and the two units on the other hand, and its holders are arranged to transfer trays between the reservoir and the tray filling or tray evacuating unit. Such apparatus can further comprise a tray storing device having means for receiving arrays (e.g., elongated rows) of trays from and for delivering arrays of trays to the reservoir. Thus, the holders of the transferring means are preferably designed to transfer discrete trays, either between the two units or between the units and the reservoir, and the reservoir can exchange entire arrays of empty or filled trays with the tray storing device. The latter preferably comprises first and second facilities for temporary storage of empty and filled trays, respectively. The storing device can include a conveyance (e.g., a wheel-mounted wagon) which is movable into and out of the reservoir. The reservoir can comprise a crane or other suitable means for moving arrays of filled or empty trays between the facilities of the conveyance and the respective facilities of the reservoir.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
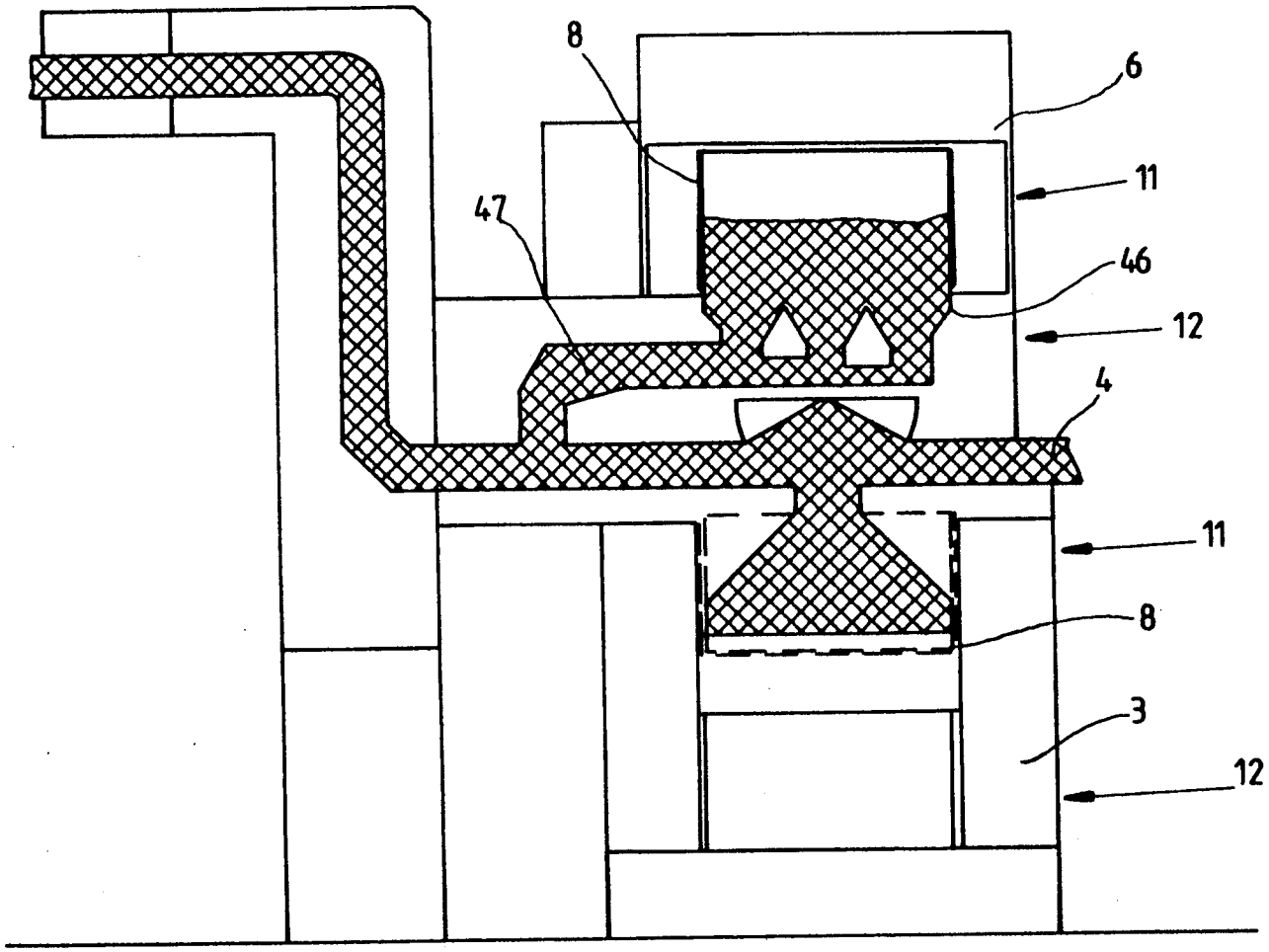
FIG. 1 is a schematic front elevational view of the tray filling and tray evacuating units, with the tray evacuating unit disposed above and the tray filling unit disposed below the path of rod-shaped articles from at least one first (article producing or processing) machine to at least one second (e.g., packing) machine.

FIGS. 1 to 4 show the details of an apparatus which is installed in a production line for the making and processing of filter cigarettes. The production line comprises a cigarette rod making machine 1 (e.g., a machine known as PROTOS which is distributed by the assignee of the present application and is described in commonly owned U.S. Pat. No. 4,697,603 granted Oct. 6, 1987 to Steinhauer et al.), a filter tipping machine 2 (e.g., a machine known as MAX which is distributed by the assignee of the present application and is described in commonly owned U.S. Pat. No. 4,776,351 granted Oct. 11, 1988 to Wahle et al.) which receives plain cigarettes of unit length or multiple unit length from the making machine 1, and a packing machine, not shown, e.g., a machine of the type described and shown in commonly owned U.S. Pat. No. 4,548,019 granted Oct. 22, 1985 to Kruse or in commonly owned U.S. Pat. No. 3,750,676 granted Aug. 7, 1973 to Kruse et al. The packing machine receives from the tipping machine 2 a mass flow 4 (FIG. 1) of parallel filter cigarettes of unit length. The improved apparatus is installed adjacent the path of movement of the mass flow 4 from the tipping machine 2 toward the packing machine, and the purpose of the apparatus is to take up the surplus of filter cigarettes when the output of the tipping machine 2 exceeds the requirements of the packing machine as well as to return filter cigarettes into the mass flow 4 when the requirements of the packing machine exceed the output of the tipping machine 2. The tipping machine 2 can serve to supply filter cigarettes to two or more packing machines or to other machines for the processing of filter cigarettes of unit length.

The improved apparatus comprises a tray filling unit 3 which serves to remove the surplus of filter cigarettes from the mass flow 4 and to introduce predetermined quantities of parallel filter cigarettes into successive empty trays 8 (also called chargers) of conventional design. Each of the illustrated trays 8 has a bottom wall 8*a* (FIG. 2), a rear wall 8*b* and two sidewalls 8*c*, 8*d* which flank the rear wall 8*b*. When a tray 8 is filled, a thick layer of parallel filter cigarettes rests on the bottom wall 8*a* between the sidewalls 8*c*, 8*d*, and one end of each filter cigarette is adjacent or abuts the rear wall 8*b*. The axes of the confined filter cigarettes are parallel to the bottom wall 8*a* and to the sidewalls 8*c*, 8*d* and are normal to the rear wall 8*b*. The filter cigarettes of the layer in a filled or partially filled tray 8 are normally in the so-called quincunx formation.

The tray filling unit 3 can be equipped with a tray filling assembly of the type described and shown, for example, in U.S. Pat. No. 3,245,558 granted Apr. 12, 1966 to Kochalski et al. This unit comprises a facility 11 for temporary storage of a row of empty trays 8, and a facility 12 for temporary storage of a row of filled trays 8. The facility 11 is located at a level above and is substantially parallel with the facility 12. Each of these facilities comprises at least one endless conveyor belt 13 the upper reach or stretch of which supports the respective row of empty and filled trays 8. The upper reach of each conveyor belt 13 in the facility 11 is or can be substantially horizontal, and the upper reach of the conveyor belt 13 in the facility 12 preferably slopes downwardly in the direction (arrow 14 in FIG. 3) of stepwise evacuation of filled trays 8 from the tray filling unit 3.

The tray evacuating unit 6 is installed at a level directly above the unit 3 and also comprises an upper facility 11 for temporary storage of empty trays 8 and a lower facility 12 for temporary storage of filled trays 8. The upper reach of each conveyor belt 13 in the facility 11 of the unit 6 is substantially horizontal, and the upper reach of each conveyor belt 13 in the facility 12 of the unit 6 slopes downwardly in the direction (arrow 16) of evacuation of filled trays 8 from the unit 6, and more specifically in the direction of advancement of successive filled trays 8 toward a location (note the arrow 41 in FIG. 3) beneath the tray emptying or evacuating station where an inverting device 43 turns successive filled trays 8 through approximately 180° in order to deliver their contents into the mass flow 4, i.e., for advancement toward the processing machine or machines. It is clear that each of the units 3 and 6 further comprises drive means for the respective conveyor belts 13 so that successive empty trays 8 in the upper facility 11 of the unit 3 can be advanced toward the tray filling station, that successive filled trays 8 in the lower facility 12 of the unit 3 can be advanced stepwise away from the tray filling station, that successive filled trays 8 in the lower facility 12 of the unit 6 can be advanced stepwise toward the location (arrow 41) beneath the inverting device 43, and that successive empty trays 8 in the upper facility 11 of the unit 6 can be advanced stepwise away from the inverting device 43.

The improved apparatus further comprises a novel and improved tray transferring device 9 which is adjacent the units 3, 6 and serves to transfer empty and/or filled trays 8 between the upper and lower storeys (facilities 11, 12) of the unit 6, between the upper and lower storeys (facilities 11, 12) of the unit 3, between the units 3 and 6, as well as between the unit 3 and/or 6 and a magazine or reservoir 7 (shown in FIGS. 4 and 5) which serves for temporary storage of entire blocks or arrays (preferably in the form of rows) of parallel empty and filled trays 8. The reservoir 7 comprises a first or upper facility 11 for temporary storage of empty trays 8, and a second or lower facility 12 for temporary storage of filled trays 8. The upper reach(es) of the conveyor belt or belts 13 in the upper facility 11 of the reservoir 7 may but need not be exactly horizontal, the same as the upper reach(es) of the conveyor belt(s) 13 in the lower facility 12 of the reservoir 7.

Figure 4:
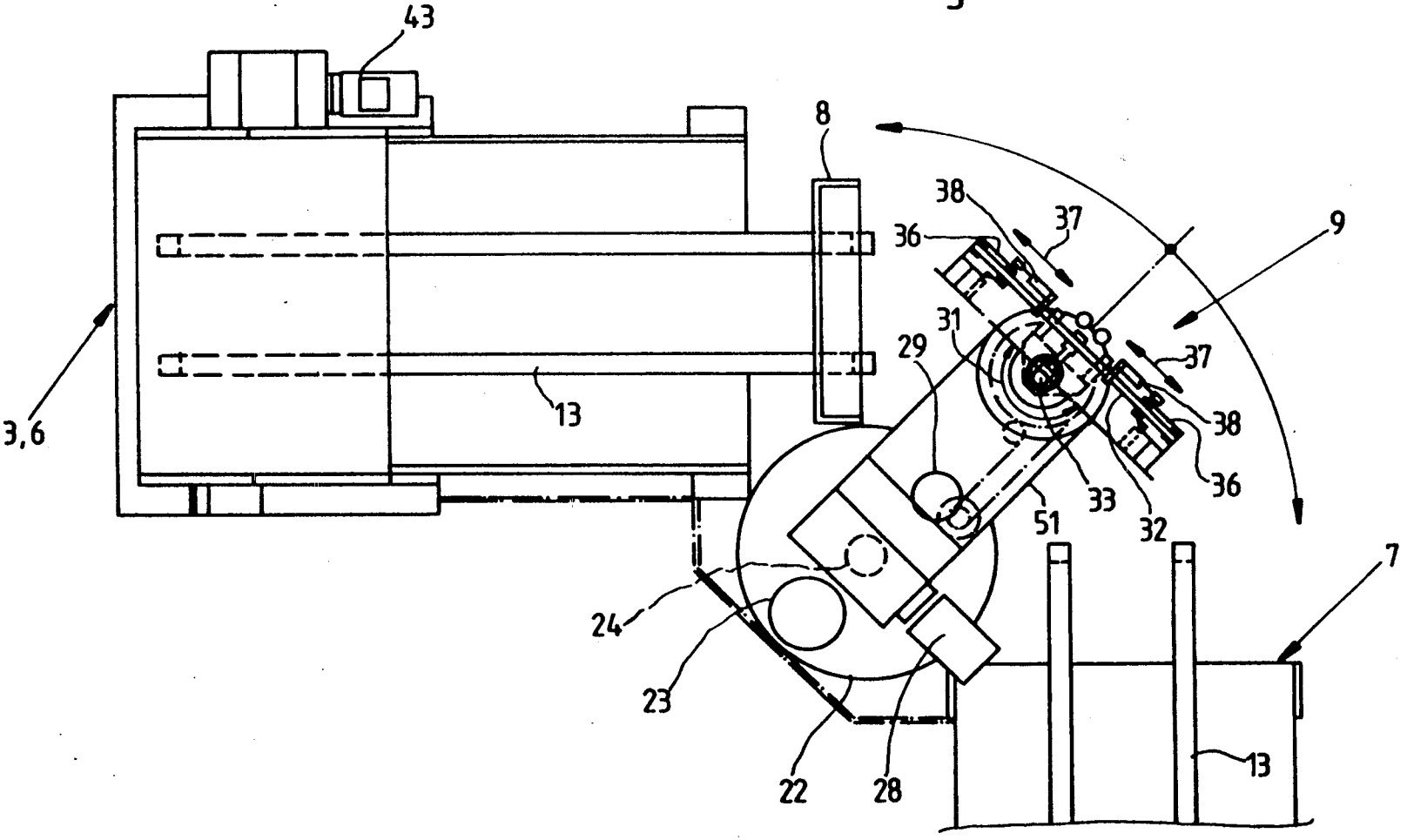
FIG. 4 is a plan view of the two units and of the tray transferring means and further shows a portion of a reservoir for temporary storage of empty and filled trays.

The reservoir 7 is elongated and extends at right angles to the facilities 11, 12 of the units 3 and 6 (see particularly FIG. 4). The transferring device 9 is disposed between one end of the reservoir 7 and the adjacent front sides of the facilities 11, 12 of the units 3 and 6. The assembly of the units 3 and 6 can be said to constitute or resemble a narrow elongated turret or block wherein the upper facility 11 of the unit 3 is located between the two facilities 12 and the upper facility 11 of the unit 6 is located above the facility 12 of this unit. This ensures that the space requirements of the units 3 and 6 are surprisingly small even though such units can temporarily store large numbers of empty and filled trays 8.

Figure 5:
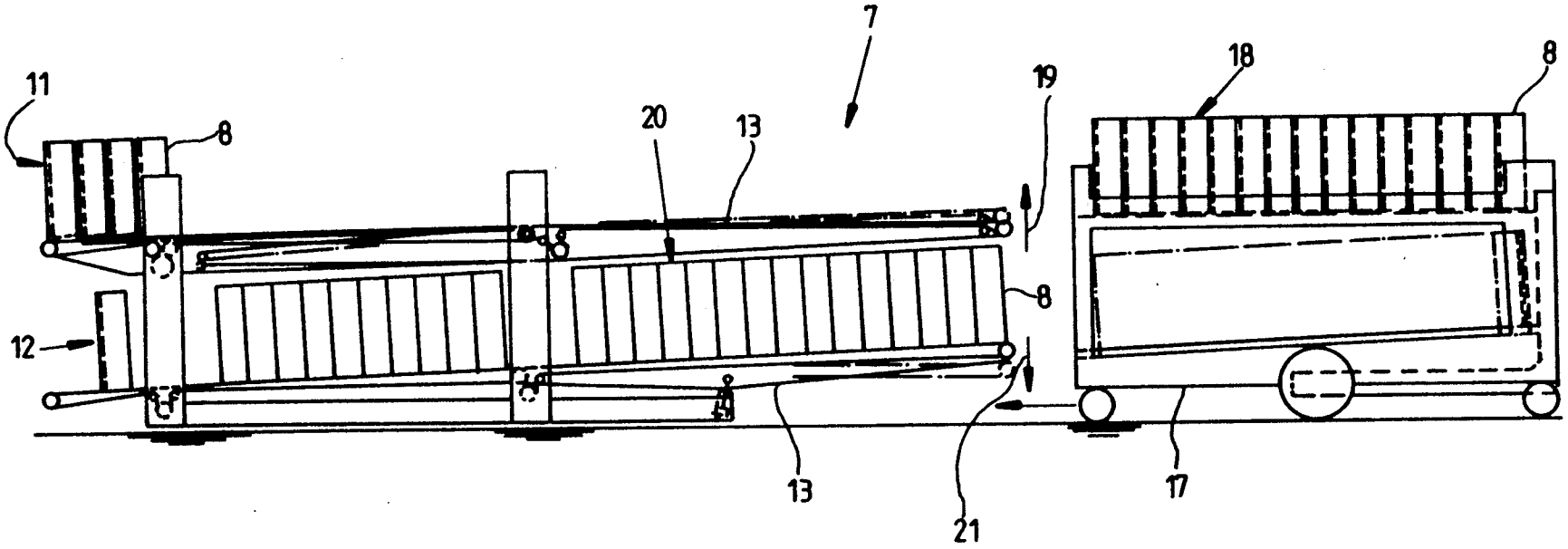
FIG. 5 is a smaller-scale elevational view of a presently preferred reservoir and of a wheel-mounted tray storing device which can exchange arrays of filled and empty trays with the reservoir.

FIG. 5 further shows a tray storing device 17 in the form of a wheel-mounted conveyance which can be put to use when the combined capacity of the units 3, 6 and reservoir 7 does not suffice to confine a requisite number of filled and empty trays 8. The storing device 17 is normally adjacent that end of the reservoir 7 which is remote from the tray transferring device 9, and the purpose of the device 17 is to accept from the reservoir 7 an entire array 18 (e.g., a long row) of parallel empty trays 8 or to deliver to the reservoir 7 a complete array 20 (e.g., a long row) of parallel filled trays 8. To this end, the device 17 can be pushed or driven by a motor all the way into the reservoir 7 while the adjacent portion(s) of the upper conveyor belt(s) 13 in the facility 11 of the reservoir 7 is or are moved in the direction of arrow 19 to provide room for introduction of the storing device 17 and to permit convenient transfer of an array 18 of empty trays 8 from the upper storey of the device 17 into the upper facility 11 of the reservoir 7 or the other way around. The means for transferring arrays 18, 20 between the reservoir 7 and the storing device 17 can comprise one or more cranes (not shown) which are associated with the reservoir or with the storing device. The righthand portion or portions of the conveyor belt(s) 13 in the lower facility 12 of the reservoir 7 can be moved downwardly (arrow 21) in order to provide room for introduction of the storing device 17 into the reservoir as well as to enable the aforementioned crane or cranes or other suitable moving or transferring devices to transfer arrays 20 of filled trays from the lower facility 12 of the reservoir 7 into the lower facility of the storing device 17 or in the opposite direction. It will be seen that one end of the reservoir 7 can exchange discrete empty or filled trays 8 with the unit 3 and/or 6 by way of the tray transferring device 9, and that the other end of the reservoir 7 can exchange entire arrays of empty or filled trays 8 with the storing device 17 by way of the aforediscussed crane or cranes.

Figure 2:
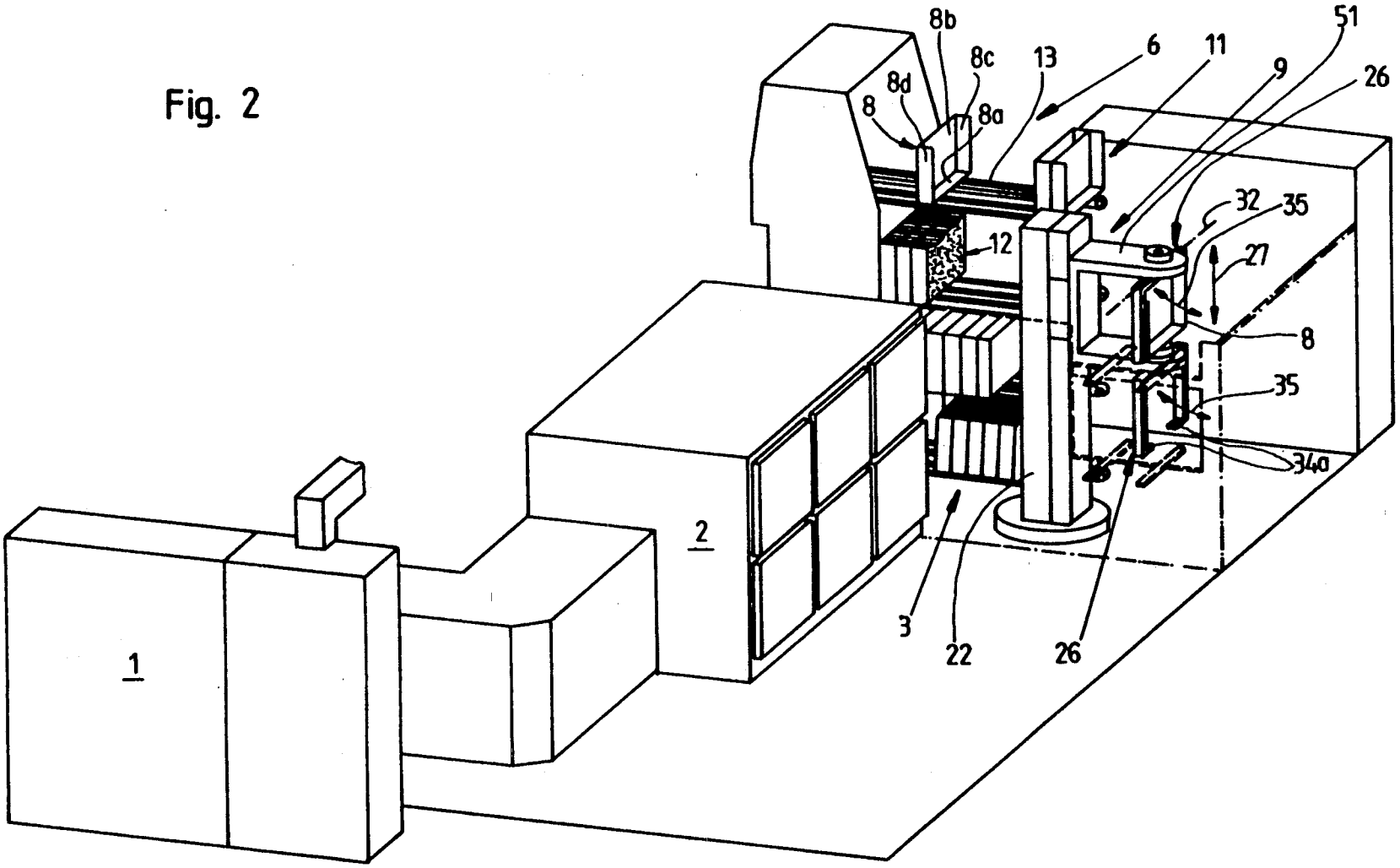
FIG. 2 is a perspective view of a production line including a cigarette rod making machine, a filter tipping machine and an apparatus which is adjacent the path of advancement of filter cigarettes from the tipping machine toward a packing or another processing machine.
Figure 3:
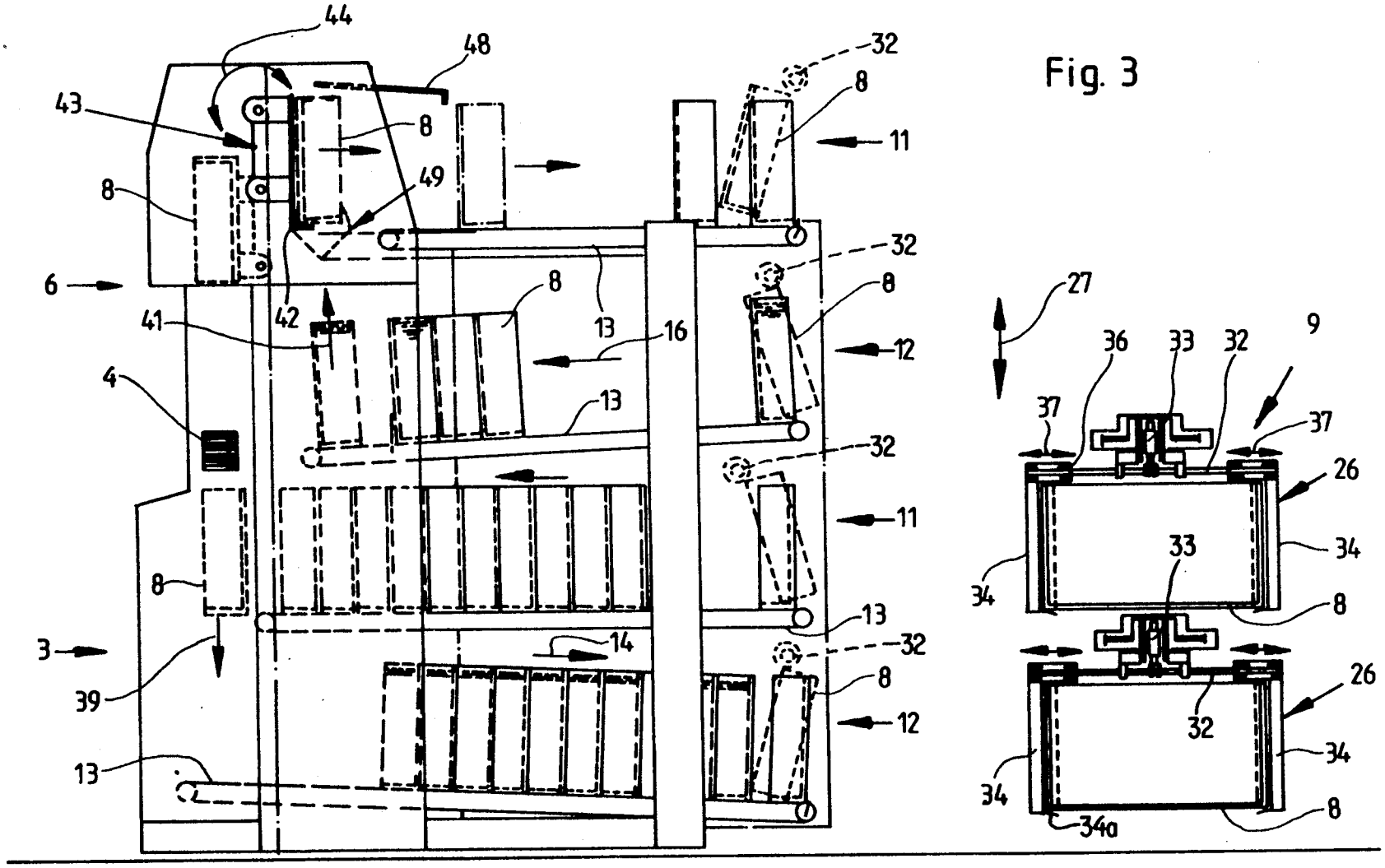
FIG. 3 is an enlarged side elevational view of the tray filling and evacuating units and further shows the two holders of the tray transferring means.

The details of a presently preferred embodiment of a tray transferring device 9 are shown in FIGS. 2, 3 and 4. As already mentioned above, this device serves to transfer trays 8 between the facilities 11, 12 of the tray filling unit 3, between the facilities 11, 12 of the tray evacuating unit 6, between the units 3 and 6 as well as between the facilities 11, 12 of the unit 3 and/or 6 on the one hand and the facilities 11, 12 of the reservoir 7 on the other hand. The device 9 comprises an upright turret 22 which is indexible about the vertical axis of a column 24 by an indexing drive 23 of any known design. The turret 22 supports a yoke 51 for two similar or identical tray holders 26 which are disposed at different levels at a mutual spacing corresponding to that of the trays 8 in the upper and lower facilities 11, 12 of the unit 3, unit 6 or reservoir 7.

The tray transferring device 9 further comprises an elevator 28 which can move the holders 26 up and down as a unit in directions indicated by a double-headed arrow 27. The range of the elevator 28 suffices to ensure that the holders 26 can be moved to the levels of the facilities 11, 12 in the unit 3 (i.e., to the levels of the facilities 11, 12 in the reservoir 7) as well as to the levels of facilities 11, 12 in the unit 6 which is located above the unit 3. Thus, the upper holder 26 can carry an empty tray 8 while the lower holder 26 carries a filled tray; this contributes to versatility of the transferring device 9 and of the entire apparatus.

Still further, the transferring device 9 comprises a drive 29 for rotating or turning the holders 26 as a unit relative to the turret 22 about a second vertical axis which is parallel to the axis of the column 24. The arrangement is preferably such that the holders 26 can turn relative to the turret 22 clockwise and counterclockwise through angles of substantially 180° (note the arrow 31 in FIG. 4). In addition, each holder 26 is tiltable about a discrete horizontal axis (note the shafts 32 in FIG. 3) which is adjacent its upper portion. The means for tilting comprises two discrete drives 33, and the directions in which the holders 26 are tiltable about the axes of the respective shafts 32 are indicated by doubleheaded arrows 35. The purpose of the tilting means 33 is to ensure that the filter cigarettes which fill a tray 8 in the upper or lower holder 26 abut the rear wall 8*b* of the respective tray during manipulation of the respective holder 26 so that the cigarettes are less likely to fall out of the tray. The rear wall 8*b* of a filled tray 8 in the upper or lower holder 26 is then inclined with reference to a vertical plane so that the confined filter cigarettes do not exhibit any tendency to escape from such filled tray by way of its open front side.

Each holder 26 is further provided or associated with means for engaging a tray 8 for transport up or down (elevator 28) about the axis of the column 24 (indexing drive 23), under the action of the turning means 29 and/or under the action of the respective tilting means 33. The engaging means can comprise discrete tongs for each holder 26, and each of these tongs can comprise two spaced apart parallel grippers 34 which can engage the two narrow parallel sides (sidewalls 8*c*, 8*d*) of an empty or filled tray 8 (see FIG. 3) after having been moved toward positions of registry with such narrow sides in a direction toward one of the broader sides (rear wall 8*b* or the open front side) of the respective tray. The grippers 34 have sleeve-like followers 36 which are slidable along the respective horizontal shafts 32 in directions indicated by double-headed arrows 37 under the action of reciprocating drives 38. Each gripper 34 includes a lower end portion 34*a* which can engage the tray 8 in the respective holder 26 from below, i.e., the portions 34*a* can engage the underside of the bottom wall 8*a* of the tray 8 in the respective holder 26.

The holders 26 can transport filled trays 8 therein in such a way that the open front sides of the trays face forwardly. On the other hand, the open sides of filled trays 8 in the facilities 12 of the units 3 and 6 face rearwardly during advancement with the upper reaches of the respective conveyor belts 13.

The mode of operation of the improved apparatus is as follows:

When the output of the tipping machine 2 matches the requirements of the packing machine or machines at the downstream end of the mass flow 4, the units 3 and 6 are idle, i.e., the unit 3 does not draw filter cigarettes from the mass flow 4 and the unit 6 does not deliver filter cigarettes into the mass flow. If the output of the tipping machine 2 exceeds the requirements of the processing machine or machines, a portion of the mass flow 4 is branched off and such portion of the mass flow is admitted into successive empty trays 8 in the upper facility 11 of the unit 3. At such time, the leftmost empty tray 8 is caused to descend in stepwise fashion (arrow 39 in FIG. 3), for example, in a manner as fully described and shown in the aforementioned U.S. Pat. No.

3,245,558 to Kochalski et al. The tray 8 which has been caused to descend in the direction of arrow 39 is filled not later than when its reaches the conveyor belt(s) 13 in the lower facility 12 of the unit 3. The unit 3 can accept a substantial quantity of filter cigarettes, depending upon the dimensions of its facilities 11 and 12 for empty and filled trays 8, respectively. If the facility 12 of the unit 3 is filled with trays 8, the transferring device 9 is set in operation to transfer filled trays 8 from the unit 3 into the unit 6 and/or into the reservoir 7.

If the requirements of the processing machine or machines exceed the output of the tipping machine 2, the unit 6 is set in operation to deliver filter cigarettes into the mass flow 4. This involves a movement of the conveyor belt(s) 13 in the lower facility 12 of the unit 6 in the direction of arrow 16 in order to advance successive foremost filled trays 8 to the station (arrow 41 in FIG. 3) beneath the inverting device 43. The foremost filled tray 8 is accepted by a suitably inclined receptacle 42 which is movable up and down between the facilities 11, 12 of the unit 6 in order to lift the filled tray 8 into the range of the inverting device 43. The latter is activated to turn the receptacle 42 and the filled tray 8 therein through an angle of approximately 180° (double-headed arrow 44 in the upper left-hand portion of FIG. 3) so that the contents of the tray are dumped into a magazine 46 (FIG. 1) which discharges the thus received filter cigarettes into a path for a branch stream 47 merging into the mass flow 4. It is also within the purview of the invention to maintain the receptacle 42 at the illustrated level and to employ a lift or a like device which raises the foremost (leftmost) filled tray 8 from the lower facility 12 of the unit 6 into the receptacle 42 before the latter is inverted by the device 43 in order to transfer the layer of filter cigarettes from such tray into the magazine 46. Reference may also be had to U.S. Pat. No. 3,672,522 granted Jun. 27, 1972 to Wahle et al.

The unit 6 can compensate for differences between the requirements of the processing machine(s) and the tipping machine 2 for a reasonably long interval of time, depending upon the number of filled trays 8 which can be stored in the lower facility 12 of the unit 6. If the number of filled trays 8 in such lower facility does not suffice, the transferring device 9 is set in operation to transfer filled trays 8 from the lower facility 12 of the unit 3 into the lower facility 12 of the unit 6 or from the lower facility 12 of the reservoir 7 into the lower facility 12 of the unit 6.

A freshly emptied tray 8 is tilted back into the upper facility 11 of the unit 6 and is advanced by an entraining device 49 upon opening of a pivotable gate or flap 48 so that such empty tray reaches the conveyor belt(s) 13 in the upper facility 11 of the unit 6 and can be transported toward the transferring device 9. The entraining device 49 can comprise one or more reciprocable grippers which can engage the empty tray 8 in the receptacle 42 for advancement in a direction to the right, as seen in FIG. 3.

The transferring device 9 is set in operation if the unit 3 cannot accept additional filter cigarettes from the mass flow 4 without prior delivery of fresh empty trays 8 into the upper facility 11 of the unit 3, and the transferring device 9 is also set in operation if the unit 6 cannot dump additional filter cigarettes into the magazine 46 except if the lower facility 12 of the unit 6 receives additional filled trays 8 from the facility 12 of the unit 3 or from the facility 12 of the reservoir 7.

The transfer of filled trays 8 and empty trays 8 between the units 3 and 6 is carried out as follows:

The device 9 is designed to simultaneously transfer a filled tray and an empty tray. Let it be assumed that the two holders 26 on the yoke 51 of the turret 22 are located at the levels of the facilities 11, 12 in the unit 3. The upper holder 26 has just completed the transfer of an empty tray 8 from the upper facility 11 of the unit 6 to the level of upper facility 11 of the unit 3. The angular position of the turret 22 is such that the yoke 51 for the two holders 26 extends transversely of (i.e., at an angle of 90° to) the longitudinal directions of conveyor belts 13 in the facilities 11, 12 of the units 3 and 6. The open sides of the holders 26 confront the adjacent ends of the conveyor belts 13. The grippers 34 are adjacent the sides of the respective holders 26 at the adjacent ends of the corresponding conveyor belts 13. The drives 38 are then actuated to disengage the grippers 34 (i.e., to open the respective tongs) so that the empty tray 8 which has been lowered by the upper holder 26 is released and comes to rest on the upper reach(es) of the conveyor belt(s) 13 in the lower facility 11 of the unit 3. Such belt or belts 13 are then set in motion by starting the corresponding drive of the unit 3 so that the freshly delivered empty tray 8 can be moved in a direction to the left (as seen in FIG. 3) toward the tray filling station (arrow 39).

At the same time, or after the deposition of an empty tray 8 on the conveyor belt(s) 13 of the upper facility 11 in the unit 3 is completed, the grippers 34 of tongs forming part of or associated with the lower holder 26 (at the level of the lower facility 12 of the unit 3) are actuated by the respective drive means 38 to engage the narrower sides of the adjacent filled tray 8 in the facility 12 of the unit 3. The tilting drive 33 is thereupon actuated to change the inclination of the lower holder 26 and of the filled tray 8 therein so that the filter cigarettes of the layer in such filled tray tend to abut the respective rear wall **8*b* and are not likely to fall out of the filled tray during subsequent transport of the filled tray to the level of the lower facility 12 in the unit 6. Lifting of the holders 26 (with a filled tray 8 in the lower holder 26) is preceded by indexing of the turret 22 7 and its yoke 51 with the two holders through 45° to the angular position of FIG. 4. This enables the rotating or turning drive 29 to turn the holders 26 through 180° (double-headed arrow 31) without any interference on the part of the units 3, 6 and reservoir 7 prior to, during or subsequent to activation of the elevator 28 in order to move the lower holder 26 and the filled turret 8 therein to the level of the lower facility 12 in the unit 6**.

The turning or rotating means 29 performs another desirable and important function, namely that of ensuring proper orientation of filter cigarettes which are dumped into the magazine 46 so that the orientation of filter cigarettes in the branch stream 47 matches that of filter cigarettes in the mass flow 4. Otherwise stated, the turning or rotating means 29 compensates for the fact that the orientation of filter cigarettes is changed during dumping by the inverting device 43 so that the ultimate orientation of filter cigarettes in the stream 47 matches that of filter cigarettes which are transferred from the mass flow 4 into successive empty trays 8 and that of filter cigarettes in the mass flow 4 receiving the filter cigarettes of the branch stream 47.

The upper holder 26 is or can be empty while the elevator 28 causes the holders 26 to rise so that the lower holder 26 can move the freshly received filled tray 8 to the level of lower facility 12 in the unit 6. The turret 22 is thereupon indexed again in order to move the yoke 51 to a requisite position for deposition of the filled tray 8 onto the upper reach or reaches of the conveyor belt or belts 13 in the lower facility 12 of the unit 6 in the same way as described above in connection with the deposition of an empty tray on the conveyor belt(s) 13 of the upper facility 11 in the unit 3. At least some of the vertical, tilting, indexing and/or other movements of the turret 22, yoke 51, holders 26 and grippers 34 can overlap in order to further shorten the intervals of time which are required to transfer empty trays 8 from the upper facility 11 into the lower facility 11 or to transfer filled trays from the lower facility 12 into the upper facility 12. Thus, the inclination of a filled tray 8 in the lower holder 26 can be changed by the drive means 33 while the elevator 28 moves the holders 26 upwardly so that the inclination of the freshly lifted filled tray 8 matches or approximates that of filled trays 8 in the facility 12 of the unit 6 even before the freshly lifted filled tray is ready to be deposited on the belt(s) 13 of this facility 12.

When the holders 26 dwell in their upper end positions, the upper holder 26 can receive an empty tray 8 from the facility 11 of the unit 6, and the engagement of such empty tray by the grippers 34 which are associated with the upper holder 26 can be immediately followed by activation of the respective tilting means 38 to thus ensure that the inclination of the empty tray 8 is changed to the broken-line position shown at the right-hand end of the upper facility in the unit 6 of FIG. 3. This, in turn, ensures that any filter cigarettes which failed to leave the respective tray 8 during inversion of the tray by the device 43 invariably leave the tray before the latter begins to descend from the upper facility 11 toward the lower facility 11 of FIG. 3. The orientation of the empty tray 8 which descends with the upper holder 26 is changed by 180° in response to actuation of the turning drive 29 so as to compensate for changes of orientation of filter cigarettes during removal from the mass flow 4.

If the device 9 is to transfer trays 8 between the unit 3 or 6 and the reservoir 7, the turret 22 is indexed through 90° instead of 45° and the holders 26 are moved by the elevator 28 and/or by other drives in order to ensure proper orientation of filled trays 8 during delivery into or from the lower facility 12 of the reservoir 7 and proper orientation of empty trays 8 during delivery into or from the upper facility 11 of the reservoir.

The disclosures of all of the aforementioned patents are incorporated herein by reference.

An important advantage of the improved apparatus is that the units 3 and 6 are closely adjacent each other and that the facilities 11, 12 of each of these units are also closely adjacent each other. This renders it possible to shorten the distances which the empty trays must cover on their way from the unit 6 to the unit 3 and which the filled trays must cover on their way from the unit 3 to the unit 6. The feature that the facilities 11, 12 of the units 3 and 6 alternate at different levels also contributes to compactness of the turret- or block-shaped assembly including the two units and hence to a shortening of distances which the trays 8 must cover during transfer between the two units.

Another important advantage of the improved apparatus is that changes of orientation of rod-shaped articles during removal from or during introduction into the mass flow 4 can be compensated for in a simple, efficient and space-saving manner, merely by employing a highly versatile transferring device 9 which can impart to the holders 26 all necessary movements prior to, during or after reception of empty or filled trays 8. Since the holders 26 can perform two or more simultaneous movements, the intervals which are required to properly orient or reorient layers of rod-shaped articles prior to dumping into the magazine 46 are surprisingly short.

A further important advantage of the improved apparatus is that rod-shaped articles which are stacked in filled trays 8 are not likely to shift positions and/or to fall out of the respective filled trays because the tilting drive 33 ensures proper inclination of the bottom walls 8*a* and of other walls of each filled tray before the respective holder is set in rotary and/or other motion for the purpose of transferring a filled tray from the reservoir 7 into the lower facility 12 of the unit 6 or from the facility 12 of the unit 3 into the facility 12 of the unit 6. The tilting drive 33 can serve the additional purpose of invariably ensuring that a tray 8 which is lowered from the facility 11 of the unit 6 or from the facility 11 of the reservoir 7 to the level of the facility 11 in the unit 3 does not contain any rod-shaped articles.

Since the distances which the trays 8 must cover on their way between the units 3 and 6 or between the units 3, 6 on the one hand and the reservoir 7 on the other hand are short or very short, the transfer of such trays can be completed within relatively short intervals of time even if the speed of movement of the trays is not very high. This is desirable in connection with the transfer of filled trays. Moreover, it is possible to resort to more gradual acceleration and deceleration of trays to thus further reduce the likelihood of misorienting the rod-shaped articles in the filled trays. Still further, such gradual acceleration and deceleration of trays 8 which contain rod-shaped articles entails gentler treatment of the articles and hence a reduction in the number of rejects. In addition, the apparatus is less likely to be clogged with rod-shaped articles so that the periods of idleness are reduced accordingly.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating empty and filled trays for temporary storage of rod-shaped articles of the tobacco processing industry, comprising a tray filling unit having means for filling empty trays with articles from a stream of articles; a tray evacuating unit having means for emptying filled trays by delivering articles from filled trays into a path for an article stream, one of said units being disposed above the other of said units and each of said units having first and second facilities for temporary storage of parallel empty and filled trays, respectively, and the first facilities of each of said units being disposed above the respective second facilities, the second facility of said evacuating unit being located above the first facility of said filling unit and said units together forming a first turret; and means for transferring trays between the facilities of said units, comprising an upper and a lower tray holder each having means for releasably engaging and moving at least one tray so that an empty tray which is carried by one of said holders can be transferred simultaneously with a filled tray which is carried by the other of said holders, a second turret for said holders, means for indexing said second turret about a substantially vertical axis, an elevator having means for moving said holders up and down relative to said second turret and means for rotating said holders relative to said second turret clockwise and counterclockwise about a second substantially vertical axis.

2. The apparatus of claim 1, wherein the articles in a filled tray which is carried by one of said holders have parallel axes which are substantially normal to said second substantially vertical axis.

3. The apparatus of claim 1, wherein said transferring means further comprises means for tilting said holders relative to said second turret about substantially horizontal axes.

4. The apparatus of claim 3, wherein each of said holders has an upper portion and a lower portion, said substantially horizontal axes being adjacent the upper portions of the respective holders and said tilting means including means for moving said holders to and from predetermined positions of inclination with reference to a vertical plane.

5. The apparatus of claim 1, wherein said means for engaging and moving includes tongs having grippers and means for moving said grippers into and from engagement with trays in the respective holders.

6. The apparatus of claim 5, wherein the trays have pairs of narrow sides and wide sides and said grippers have means for engaging the narrow sides of the trays in the respective holders.

7. The apparatus of claim 5, wherein each of said tongs comprises two substantially parallel grippers and said grippers have means for supporting the trays from below.

8. The apparatus of claim 1, further comprising a reservoir for filled and empty trays, said transferring means being disposed between said units on the one hand and said reservoir on the other hand and having holder means arranged to transfer trays between said reservoir and said units, said reservoir having first and second facilities for temporary storage of empty and filled trays at different levels.

9. The apparatus of claim 8, further comprising a tray storing device having means for receiving arrays of trays from and for delivering arrays of trays to said reservoir, said holder means being operative to transfer discrete trays between said reservoir and said units.

10. The apparatus of claim 9, wherein said storing device has first and second facilities for temporary storage of empty and filled trays, respectively.

11. The apparatus of claim 10, wherein said storing device includes a conveyance which is movable into and out of said reservoir.

12. The apparatus of claim 11, wherein said reservoir comprises means for moving arrays of trays between the facilities of said conveyance and the respective facilities of said reservoir.

13. The apparatus of claim 1, wherein said path extends between at least one first machine and at least one second machine, said means for filling empty trays having means for removing articles from said stream of articles when the output of the at least one first machine exceeds the requirements of the at least one second machine and said means for emptying filled trays comprising means for delivering articles from filled trays into said path when the requirements of the at least one second machine exceed the output of the at least one first machine.

* * * * *